United States Patent [19]

Toledo

[11] Patent Number: 5,050,268

[45] Date of Patent: Sep. 24, 1991

[54] DOOR CLOSER WITH BACK CHECKING MEANS

[75] Inventor: George F. Toledo, Fall Brook, Calif.

[73] Assignee: Thomas Industries, Inc., Los Angeles, Calif.

[21] Appl. No.: 655,220

[22] Filed: Feb. 12, 1991

Related U.S. Application Data

[63] Continuation of Ser. No. 376,401, Jul. 6, 1989, abandoned, which is a continuation-in-part of Ser. No. 70,024, Jul. 6, 1987, abandoned.

[51] Int. Cl.[5] ..... E05F 3/00

[52] U.S. Cl. ..... 16/53; 16/58; 16/86 R

[58] Field of Search ..... 16/53, 60, 70, 71, 76, 16/84, 86 R, 86 A, DIG. 9, DIG. 10, DIG. 17, DIG. 21

[56] References Cited

U.S. PATENT DOCUMENTS

| | | | |
|---|---|---|---|
| 1,095,370 | 5/1914 | Bardsley | 16/84 |
| 1,986,744 | 7/1935 | Maxworthy | 16/86 A |
| 2,158,417 | 5/1939 | Garrison | 16/53 |
| 3,675,270 | 7/1972 | Jentsch | 16/53 |
| 3,979,790 | 9/1976 | Chiarappa | 16/84 |
| 4,064,589 | 12/1977 | Bejarano | 16/53 |

FOREIGN PATENT DOCUMENTS

| | | | |
|---|---|---|---|
| 1221422 | 2/1971 | United Kingdom | 16/53 |
| 2193757 | 2/1988 | United Kingdom | 16/71 |

OTHER PUBLICATIONS

Websters II New Riverside University Dictionary, Riverside, 1984, p. 704.

*Primary Examiner*—Richard K. Siedel
*Assistant Examiner*—Edward A. Brown
*Attorney, Agent, or Firm*—Hill, Van Santen, Steadman & Simpson

[57] ABSTRACT

An improved door closer is provided which has a back checking arrangement including a loosely held resilient cushion bar which is engaged by a metallic shield abutting sliding cam plates during a final few degrees of opening of a door to provide an increasing resistance against further opening of the door. The shield preferably engages the cushion bar approximately 4° prior to a normal full open position of the door. Selective thickness of the cushion bar provides either a 90° full open position of the door or a 150° full open position of the door without additional adjustment.

21 Claims, 1 Drawing Sheet

FIG. 1
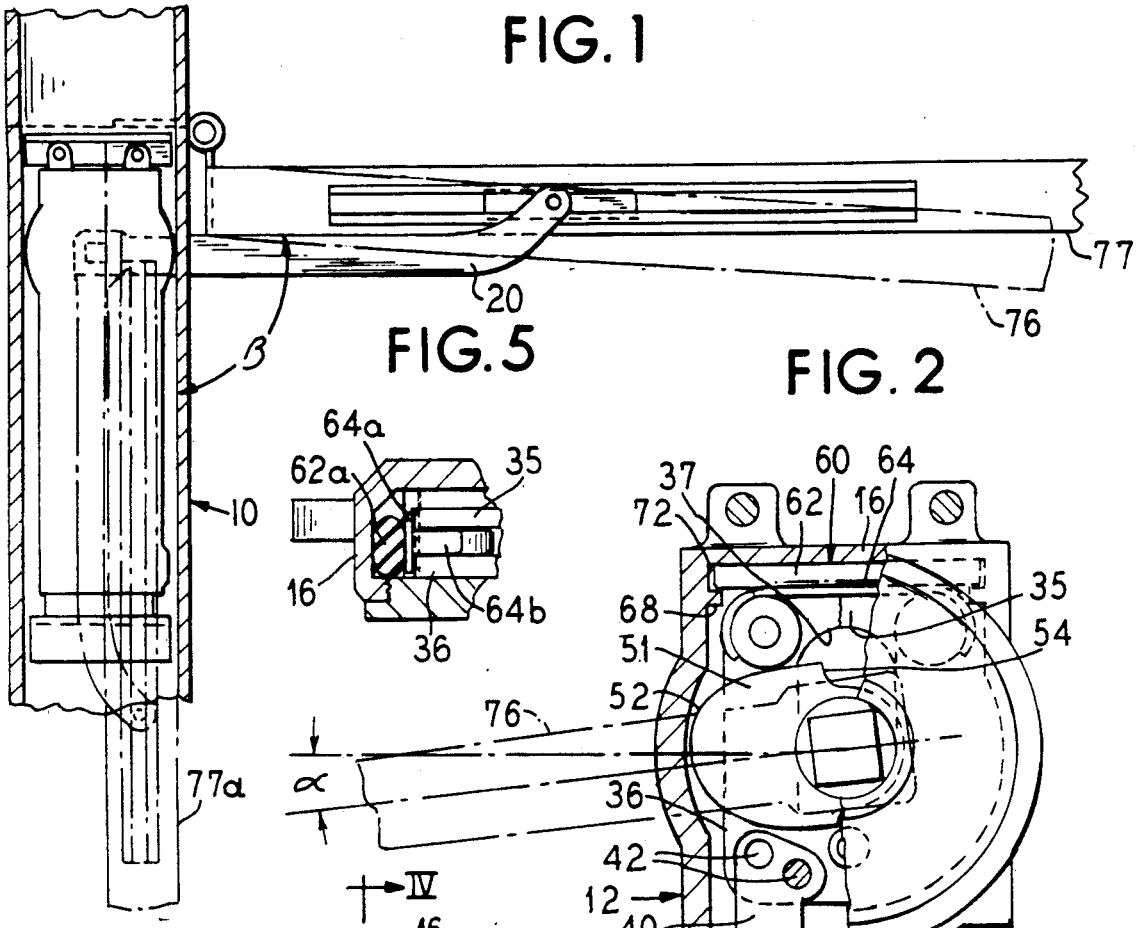
FIG. 5
FIG. 2
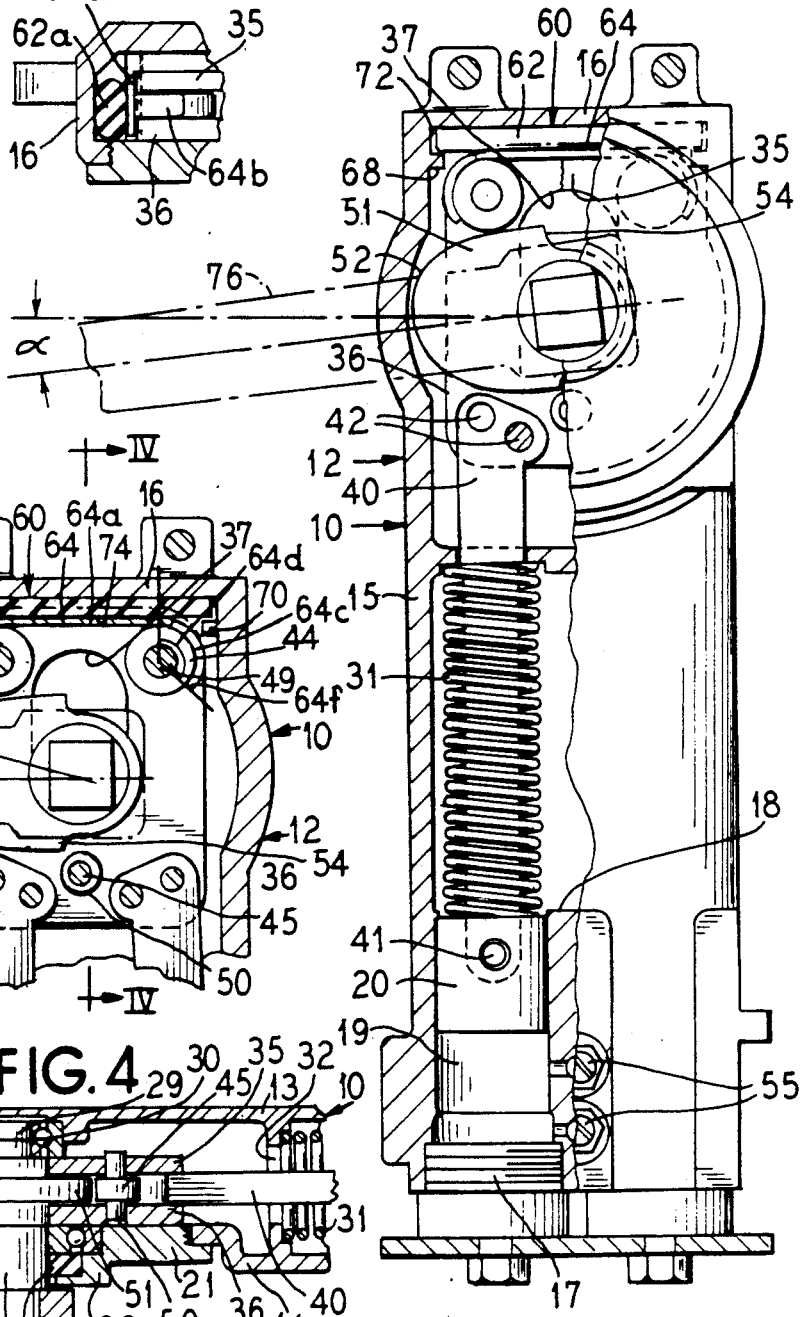
FIG. 3
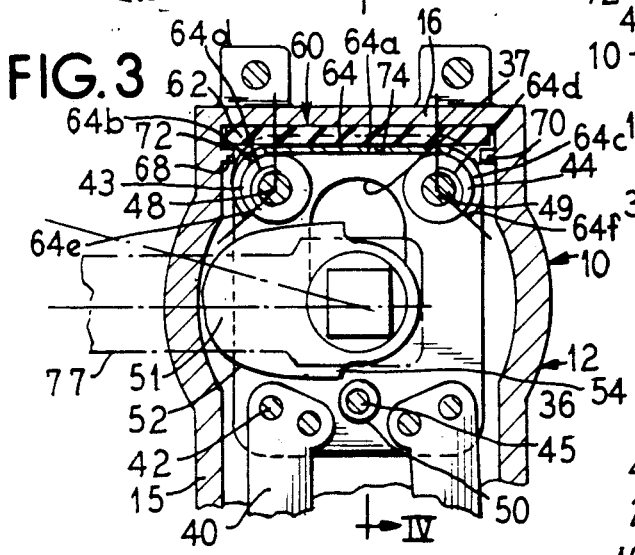
FIG. 4
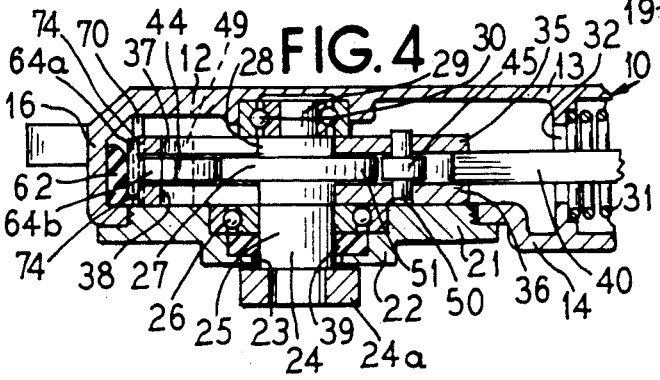

DOOR CLOSER WITH BACK CHECKING MEANS

This is a continuation of application Ser. No. 376,401, filed July 6, 1989, which is a continuation-in-part of U.S. Ser. No. 070,024, filed on July 6, 1987, and both now abandoned.

BACKGROUND OF THE INVENTION

The present invention relates to closers for doors and, more particularly, to an automatic door closer with a back checking device.

There are currently available several types of door closing mechanisms which provide a means for regulating the opening movement of a door and to prevent an overextension of the door opening commonly referred to as back checking. For example, U.S. Pat. No. 4,064,589 to Bejarano et al discloses a door closer in which an adjustable valve 132 is provided to regulate the back checking of the door which provides an adjustable shock absorber for the door as it reaches the fully opened position. This patent also discloses the use of a cushioning pad 157 to cushion a rearward movement of the carrier plate against the rear wall of the cam housing upon abrupt opening of the door past a normal/full open position. However, no means of attachment for the cushioning pad are disclosed.

U.S. Pat. No. 3,675,220 to Jentsch discloses a hydraulic cushioning device screwed through the door closer housing at a rear wall of the door closer housing, wherein a door closer cam forces plate-like members against the hydraulic cushioning device to slow the final stages of opening of the door. Mechanical energy of the door is dissipated to slow the door opening by throttling hydraulic fluid passing from the hydraulic cushioning device into the door closer housing, during compression of the hydraulic cushioning device.

U.S. Pat. No. 3,701,180 to Jentsch et al discloses a door closer wherein a stud assembly comprising a compressible material replaces the hydraulic cushioning device disclosed in U.S. Pat. No. 3,675,220. Similar to U.S. Pat. No. 3,675,220, the stud assembly is screwed through the housing.

U.S. Pat. No. 3,246,362 to A. Jackson discloses a door closer which relies on a compression of springs 31 as a back checking restraint and also relies on engagement between a cam 51 and cam follower rollers 43, 44 and 45 to provide a stop at a full open position of the door.

A back checking device which comprises a loosely captured cushion bar which provides an increasing resistance to the opening of a door during the last few degrees of travel until reaching a normal full open position, is new to the art.

SUMMARY OF THE INVENTION

The present invention provides an improved means for back checking the opening of the door in a door closer of a type described above in which there is a cam plate which slides longitudinally within the body of the door closer as the door is open and closed. A cushion bar fabricated of a resilient material is easily, loosely captured at a rear wall of the housing. A metallic shield, which is engaged to two cam follower rollers and abuts the cam plates facing the cushion bar, compresses the cushion bar when the door is opened to within a few degrees of a normal full open position. Such a normal full open position generally is selected as either 90° or 105° relative to the plane of the door jam, or the door in a closed position.

When the door is opened to within the last few degrees of its permitted arc of travel, preferably approximately 4°, the shield will engage the cushion bar and further opening of the door will begin compression of the cushion bar. As the door is continued to be opened through its last few degrees of travel, resistance to such travel is increased due to compression of the cushion bar, thus, providing an effective back checking of the door movement.

This cushion bar arrangement provides the function of a back check valve without requiring expensive machining of the door closer body for the acceptance of a fluid-type valve and the necessary porting of hydraulic fluid as is required by the use of a reverse check valve such as that disclosed in U.S. Pat. No. 4,064,589, discussed above.

Also, the cushion bar arrangement of the present invention does not require expensive machining of the door closer body for the acceptance of screwed-in cushioning devices, such as disclosed in U.S. Pat. No. 3,675,220 and U.S. Pat. No. 3,701,180, discussed above. The deletion of devices which must be screwed into the door closure housing further provides the advantage of avoiding leakage problems, since the interior of the door closer housing is filled with a hydraulic fluid under pressure. Threaded connections into the door closer housing invite leakage problems.

As mentioned above, the cushion bar is loosely captured within the door closer housing at the rear wall of the housing. As opposed to adhesively or mechanically fixing the cushion bar to the rear wall of the housing, this arrangement provides an efficient and economical approach to assembly or to replacement of the cushion bar. Additionally, two interchangeable cushion bars are provided in the present invention which provide normal full open door angles of 90° or 105°. To select a normal full open door angle, no other adjustments are required beyond simply selecting the proper cushion bar.

The present invention can be utilized in any door closer in which the cam plates slide within the door closer body and have a position close to a wall of the closer body.

BRIEF DESCRIPTION OF THE DRAWINGS

FIG. 1 is a top view of a door closer embodying the principles of the present invention which is enclosed within a door header and communicates with a door;

FIG. 2 is a partial sectional view of a door closer embodying the principles of the present invention showing the position of the cam plates when the door is nearly in the full open position;

FIG. 3 is a partial sectional view of the door closer in the full open position;

FIG. 4 is a partial side sectional view taken generally along the lines IV—IV of FIG. 3; and FIG. 5 is a partial side sectional view taken generally along the lines IV—IV of FIG. 3 showing an alternate embodiment of a cushion bar.

DESCRIPTION OF THE PREFERRED EMBODIMENTS

The present invention consists of an improved door closer and is illustrated in an embodiment of the spring actuated, hydraulic-pot type, such as that disclosed in U.S. Pat. No. 3,246,362, which disclosure is incorporated herein by reference. The present invention provides for an improved back checking arrangement to provide a positive back checking function without the complexity and cost of a fluid-type valve.

A door closer embodying the principles of the present invention is shown generally at 10 in FIGS. 1–4; FIG. 1 illustrating the closer 10 mounted in a concealed manner in the header portion of a door frame and illustrating the closed, nearly full open and normal full open positions of the door.

FIGS. 2–4 show the closer in more detail where it is seen that the closer has a housing or body 12 formed of top and bottom walls 13 and 14, side walls 15, and a rear end or back wall 16, the other end wall being provided by a pair of plug members 17. The entire hollow portion within the housing forms a reservoir for a supply of oil or other hydraulic fluid. A central partition 18 extends partially in from one end, the partition and the side walls 15 forming a pair of hollow cylinders 19 for a pair of pistons 20.

The bottom wall 14 is provided with a threaded opening in which is engaged a threaded cover plate 21, the plate having a boss 22 with a central opening 23. Extending through the opening is the spindle or door pivot member 24, this member having a non-circular end portion 24*a* for attachment to a door, such as for reception in a non-circular hole in a door hinge arm 20. The member 24 also includes a cylindrical portion 25 journaled in a ball bearing 26, a pair of shoulder or collar portions 27 and 28, and an end cylindrical portion 29 journaled in a ball bearing 30. An annular oil seal 39 is provided around the portion 25.

The closer is provided with a pair of coiled springs 31, one end of each bearing against one of a pair of internal wall portions 32, the other end bearing against one of the pistons 20. Means are provided for operably connecting the springs to the spindle member 24 and, as shown in the drawings, these means may include a pair of spaced cam plate members 35 and 36, each provided with a slot 37, 38 within each of which is received the appropriate one of the shoulders 27 and 28. A piston rod 40 is connected at one end to each of the pistons 20 by means of a pin 41. The other ends of the rods 40 are secured to the plates 35 and 36 by means of pins 42. The plates 35 and 36 are further spaced apart by means of three cam follower rollers 43, 44 and 45 mounted for rotation on respective shafts 48, 49 and 50. A cam 51 is carried on a spindle member 24 between the shoulder portions 27 and 28, the cam having a cam surface 52 with a pair of hold-closed recesses 54. Valve means 55 are provided in the central partition 18 defining the cylinders 19 to regulate the door closing and latching speeds as is discussed in greater detail in U.S. Pat. No. 3,246,362. FIG. 2 shows two separate valve members utilized for regulating the closing and latching speeds, but the present invention can also be utilized in single valve closers.

The present invention provides an improvement in regulating the back checking of the door closer, that is, regulating the amount of travel of the door in the opening direction.

The back checking arrangement provided by the present invention is illustrated generally at 60 and comprises a cushion bar 62 which is in the form of a pad of elastomeric material which abuts the back wall 16 of the housing on one side and abuts a metallic shield 64 on another side opposite the back wall 16. A pair of short, opposed walls 68, 70 project inwardly from the side walls 15 of the closer body to provide a pocket 72 in which the cushion bar is captured. Separate retaining means are not required to hold the cushion bar 62 in place.

The metallic shield 64 is a generally C-shaped member and comprises a generally rectangular bearing portion 64*a* and arcuate clasp portions 64*b*, 64*c* formed of a resilient material, such as spring steel. The bearing portion 64*a* abuts a rear edge or face 74 of the plates 35, 36 and faces the cushion bar 62. The arcuate clasp portions 64*b*, 64*c* are connected to, or integral with, the bearing portion 64*a*, one at each end of bearing portion 64*a*. The arcuate clasp portion 64*b* surrounds an outward portion of a circumference of the cam follower roller 43 and the other arcuate clasp portion 64*c* surrounds an outward portion of a circumference of the cam follower roller 44. The arcuate clasp portions 64*b*, 64*c* surround the circumferences of the cam follower rollers 43, 44 to an engagement angle 64*d*, sufficiently greater than 90° to prevent the shield from inadvertently disengaging the cam follower rollers 43, 44. The engagement angle 64*d* is measured between a line drawn from the center of the cam follower roller 43 toward and perpendicular to the bearing portion 64*a* and a line from the center of the cam follower roller 43 to an extreme end 64*e* of the arcuate clasp portion 64*b*. A similar method is used to draw the angle 64*d* for the arcuate clasp portion 64*c*, as shown in FIG. 3. The engagement angle 64*d* is therein measured between a line drawn from the center of the cam follower roller 44 toward and perpendicular to the bearing portion 64*a* and a line from the center of the cam follower roller 44 to an extreme end 64*f* of the arcuate clasp portion 64*c*. The engagement angle 64*d* being greater than 90° but less than 180° permits the shield 64 to be snapped onto cam follower rollers 43, 44 and removably retained thereon.

The thickness of the cushion bar is selected such that as the door is moved to an open position, and as rotation of the cam 51 riding on the follower rollers 43 or 44 causes the plates 35 and 36 to move rearwardly, the shield 64 will engage the cushion bar 62 when the door reaches an opening angle $\alpha$ of approximately four degrees less than a full open position for the door. Such a nearly full open position is illustrated at 76 in FIG. 1. As the opening of the door continues, the continued rearward movement of the cam plates 35 and 36 and the shield 64 will cause the cushion bar 62 to compress, thus, increasing the resistance to further opening of the door. This resistance will increase through the final four degrees of opening until full compression occurs at the normal full open position, illustrated at 77, thus, preventing the door from opening any further.

Since the cam plates 35 and 36 are metallic, the metallic shield 64 is provided both to distribute the forces presented by the rear faces 74 of the cam plates across a larger surface area of the cushion bar as well as to prevent wear of the cushion bar by engagement with the plates. Since the cushion bar 62 is relatively loosely held in the pocket 72, it can be readily removed and replaced if excessive wear does occur.

A further inventive feature of the present invention is an interchangeability of cushion bars to modify a normal full open door angle $\beta$. The normal full open door angle $\beta$ is an angle between the door closed position 76*a* and the normal full open position 77. Industry custom makes two maximum door opening angles desirable, 90° and 105°.

FIG. 4 shows the cushion bar 62 comprising a generally semi-circular or semi-oval cross section. The cushion bar 62 comprises a compression thickness which corresponds to a normal full open door angle of 105°. An alternate embodiment of the cushion bar 62 is shown in FIG. 5, wherein an alternate cushion bar 62*a* comprises a full circular or full oval cross section with a compression thickness corresponding to a normal full open door angle of 90°. The invention provides interchangeability of these two cushion bars 62, 62*a* for selection of normal full open door angles. No further adjustments of the back checking arrangement are required to select between 90° or 105°, thus, misadjustments are prevented.

Thus, it is seen that there is provided an improved door closer which has an effective back checking arrangement, which provides the functions of a back check valve without requiring the machining and cost of a fluid-type valve but which does provide a positive back checking function and which provides an increasing resistance to opening during the final few degrees of opening of a door. Such a back checking arrangement can be utilized in any door closer in which there is a sliding or moving member which can engage the resilient cushion bar during a final few degrees of opening movement.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim:

1. A door closer comprising:

a housing having top, bottom, side and back walls;

at least one member movable within said housing;

a cam within said housing which, when connected to a door, rotates in response to an opening and closing movement of said door between a closed position and a normal full open position to drivingly engage said member to move said member during an opening movement of said door; and back checking means comprising a resilient cushion bar having a front face and a perimeter edge surrounding said front face, the cushion bar arranged interior of said housing and engageable and compressible by said member during a final few degrees of opening of said door prior to said normal full open position to provide an increasing resistance to opening of said door during said final few degrees of opening; and said housing providing wall means projecting inwardly from at least one of said walls beyond said perimeter edge of said resilient cushion bar for capturing said cushion bar at a select position within said housing.

2. A door closer according to claim 1, wherein said member moves in a rearwardly direction during an opening movement of said door, said back checking means being positioned adjacent to said back wall of said housing.

3. A door closer according to claim 2, wherein said housing provides a access portion and wherein said wall means form a slot-like pocket in said housing adjacent to said back wall and openable to said access portion to provide a space for inserting and retaining said cushion bar adjacent to said back wall.

4. A door closer according to claim 1, wherein said door closer further comprises a metallic shield secured to said member on a side facing said cushion bar, whereby said shield will engage said cushion bar upon rearward movement.

5. A door closer according to claim 1, wherein said member engages said back checking means approximately 4 degrees prior to a normal full open position of said door.

6. A door closer according to claim 1, wherein said resilient cushion bar is of a selective thickness such that said cushion bar is fully compressed when said door is at the normal full open position, wherein said normal full open position of said door is 90° from a closed position of said door.

7. A door closer according to claim 1, wherein said resilient cushion bar is of a selective thickness such that said cushion bar is fully compressed when said door is at the normal full open position, wherein said normal full open position of said door is 105° from a closed position of said door.

8. A door closer comprising:

a housing;

at least one member movable within said housing, wherein said member comprises a plurality of cam follower rollers;

a cam within said housing which, when connected to a door, rotates in response to an opening and closing movement of said door between a closed position and a normal full open position to drivingly engage said cam follower rollers of said member during an opening movement of said door; and back checking means comprising a resilient cushion bar loosely captured interior of said housing and engageable and compressible by said member during a final few degrees of opening of said door prior to said normal full open position to provide an increasing resistance to opening and a metallic shield secured to said member on a side facing said cushion bar, whereby said shield will engage said cushion bar upon rearward movement, and said shield is secured to two of said rollers.

9. A door closer according to claim 8, wherein said shield comprises a C-shape providing a bearing portion abutting said cushion bar during engagement of said shield to said cushion bar, and two arcuate clasp portions at opposite ends of said bearing position, each clasp portion surrounding a portion of a circumference of one of said rollers such that said shield removably grips two of said rollers.

10. A door closer comprising:

a housing having top, bottom, side and back walls;

a spindle member rotatably mounted in said housing for securing said closer to a door;

a cam plate slidably mounted within said housing about said spindle member;

a cam carried by said spindle member, said cam having a cam surface engageable with said cam plate for linear movement of said plate upon rotation of said cam, said cam rotating in response to an opening and closing movement of said door between a closed position and a normal full open position; and means for back checking the opening of the door, said means including a resilient cushion bar having a front face and a perimeter edge surrounding said front face, the cushion bar arranged interior of said housing, engageable and compressible by said cam plate during a final few degrees of opening of the door prior to said normal full open position to provide an increasing resistance to opening of said door during said final few degrees of opening; and said housing providing wall means projecting inwardly from at least one of said walls beyond said perimeter edge of said resilient cushion bar for capturing said cushion bar at a select position within said housing.

11. A door closer according to claim 10, wherein said cushion bar is positioned adjacent said back wall of said housing and said cam plate moves rearwardly in response to an opening of said door to provide said engagement between said cam plate and said cushion bar.

12. A door closer according to claim 11, wherein said housing provides a access portion and wherein said wall means form a slot-like pocket in said housing adjacent to said back wall and openable to said access portion to provide a space for inserting and retaining said cushion bar adjacent to said back wall.

13. A door closer according to claim 12, wherein said door closer further comprises a metallic shield secured to said cam plate between said cam plate and said cushion bar, whereby said shield will engage said cushion bar upon rearward movement of said cam plate.

14. A door closer according to claim 10, further including valve means for regulating the closing speed of said door.

15. A door closer according to claim 14, wherein said valve means comprises two valves for regulating both a closing speed and latching speed of said door.

16. A door closer comprising:

a housing having a back wall;

at least one member movable longitudinally within said housing, said member having a metallic shield removably attached to a rearward side of said member;

a cam within said housing which, when connected to a door, rotates in response to an opening and closing movement of said door between a closed position and a normal full open position to drivingly engage said member to move said member in a rearward direction during an opening movement of said door;

back checking means comprising a resilient cushion bar positioned adjacent to said back wall and facing said shield on a side of said bar facing away from said back wall; and a pocket formed in said housing adjacent to said back wall to provide a space for loosely capturing said back checking means adjacent to said back wall, said back checking means being engageable and compressible by said shield during a final few degrees of opening of said door prior to said normal full open position to provide an increasing resistance to opening of said door during said final few degrees of opening.

17. A door closer according to claim 16, wherein said member engages said back checking means approximately 4° prior to a full open position of said door.

18. A door closer according to claim 16, wherein said member comprises a plurality of cam follower rollers which are engaged by said cam to move said member, and said shield is secured to two of said rollers.

19. A door closer according to claim 18, wherein said shield comprises a C-shape providing a bearing portion abutting said cushion bar during engagement of said shield to said cushion bar, and two arcuate clasp portions at opposite ends of said bearing position, each arcuate clasp portion surrounding a portion of a circumference of one of said rollers such that said shield removably grips two of said rollers.

20. A door closer according to claim 16, wherein said resilient cushion bar has a cross sectional shape of a closed geometric figure with curved contours.

21. A door closer according to claim 20, wherein said resilient cushion bar is selected from the group consisting of: an ellipsoid cross sectional cushion bar corresponding to a normal full open door angle of 90°, and a semi-ellipsoid cross sectional cushion bar corresponding to a normal full open door angle of 105°.

* * * * *